US008230882B2

(12) United States Patent
Lacher

(10) Patent No.: US 8,230,882 B2
(45) Date of Patent: Jul. 31, 2012

(54) TELESCOPING WATER OUTLET

(75) Inventor: Wolf-Dieter Lacher, Muellheim (DE)

(73) Assignee: Neoperl GmbH, Muellheim (DE)

( * ) Notice: Subject to any disclaimer, the term of this patent is extended or adjusted under 35 U.S.C. 154(b) by 412 days.

(21) Appl. No.: 12/527,524

(22) PCT Filed: Nov. 16, 2007

(86) PCT No.: PCT/EP2007/009919

§ 371 (c)(1),
(2), (4) Date: Aug. 17, 2009

(87) PCT Pub. No.: WO2008/101528

PCT Pub. Date: Aug. 28, 2008

(65) Prior Publication Data

US 2010/0116370 A1 May 13, 2010

(30) Foreign Application Priority Data

Feb. 21, 2007 (DE) ..... 10 2007 008 537

(51) Int. Cl.
*B05B 15/06* (2006.01)

(52) U.S. Cl. ..... 137/801; 138/114; 239/165; 239/281; 239/587.1

(58) Field of Classification Search ..... 137/801; 138/112, 114, 31, 46; 239/159, 163, 134, 239/135, 280.5, 280, 281, 587.1; 4/567–569, 4/615

See application file for complete search history.

(56) References Cited

U.S. PATENT DOCUMENTS 1,360,382 A * 11/1920 Edwards ..... 285/302
1,799,815 A * 4/1931 Hoff ..... 4/570
2,080,350 A 5/1937 Waldron
2,776,168 A * 1/1957 Schweda ..... 239/587.4
3,084,869 A * 4/1963 Hutty et al. ..... 239/201
4,360,159 A * 11/1982 Haynes ..... 239/282
4,652,024 A * 3/1987 Krohn ..... 285/111
5,492,430 A * 2/1996 Jones ..... 403/109.5
6,045,284 A * 4/2000 Chiu ..... 401/289

(Continued)

FOREIGN PATENT DOCUMENTS

DE 20 2006 010 113 U1 11/2006

(Continued)

OTHER PUBLICATIONS

International Search Report dated Apr. 3, 2008 with partial English translation (Four (4) pages).

(Continued)

*Primary Examiner* — Craig Schneider
*Assistant Examiner* — R. K. Arundale
(74) *Attorney, Agent, or Firm* — Crowell & Moring LLP

(57) ABSTRACT

A telescoping water outlet includes an inner pipe, at least a longitudinal portion of which is enclosed by an outlet pipe, forming an annular space between the two pipes. An inner pipe head is mounted to and closes the end of the inner pipe that is nearest the outlet opening, and includes an annular flange that bears displaceably against an inner wall of the outlet pipe. A blocking device that is slidably mounted between the inner pipe and the outlet pipe delimits a longitudinal end of the annular space, and a braking element delays or prevents a telescoping movement of the water outlet, in response to either a pressure change in the annular space, or a relative movement between the inner pipe and the outlet pipe.

16 Claims, 4 Drawing Sheets

U.S. PATENT DOCUMENTS

| | | | | |
|---|---|---|---|---|
| 6,158,469 | A * | 12/2000 | Yen | 137/801 |
| 6,256,808 | B1 * | 7/2001 | Graham et al. | 4/615 |
| 6,438,767 | B1 * | 8/2002 | Warshawsky | 4/567 |
| 6,619,570 | B1 * | 9/2003 | Ericksen et al. | 239/532 |
| 7,296,758 | B2 * | 11/2007 | Zhou | 239/200 |
| 7,546,646 | B2 * | 6/2009 | Shien | 4/615 |
| 7,753,291 | B2 * | 7/2010 | Gilmore | 239/443 |
| 2006/0196969 | A1 * | 9/2006 | DeSantis et al. | 239/205 |
| 2006/0201562 | A1 | 9/2006 | Gloor | |

FOREIGN PATENT DOCUMENTS

| | | |
|---|---|---|
| EP | 1 707 692 A1 | 10/2006 |

OTHER PUBLICATIONS

Form PCT/ISA/237 (Five (5) pages), 2008.

* cited by examiner

TELESCOPING WATER OUTLET

This application is a national stage of PCT International Application No. PCT/EP2007/009919, filed Nov. 16, 2007, which claims priority under 35 U.S.C. §119 to German Patent Application No. 10 2007 008 537.2, filed Feb. 21, 2007, the entire disclosure of which is herein expressly incorporated by reference.

The present invention is directed to a telescoping water outlet having an inner pipe designed as a through-flow pipe and an outer pipe formed as a discharge pipe. The outer pipe surrounds the inner pipe at a distance, so that an annular casing space is formed between the two.

BACKGROUND OF THE INVENTION

European patent document EP 1 707 692 A1 discloses a telescoping water outlet of this general type, which has an outflow conduit system that can be telescoped by a displacement distance. The outflow conduit system of this prior-art water outlet comprises a through-flow pipe, which is retained on the basic fitting body, and an outflow pipe, which can be moved longitudinally in relation to the through-flow pipe, one pipe being an inner pipe and the other being an outer pipe. The inner pipe has a closed end and a radial through-passage at a distance from the closed pipe end, which distance corresponds at least to the displacement distance. The radial through-passage connects an interior of the inner pipe permanently to a casing space, which has a constant volume, and is delimited by the inner pipe and the outer pipe.

Since the casing space, through which the water flows, maintains a constant volume when the telescoping water outlet is extended or retracted (when the control cartridge disposed in the basic fitting body is closed) no water flows out of a water-outflow opening of the sanitary fitting when the system is retracted, and no air, water or solid is taken into the outflow conduit system through the water-outflow opening when the system is extended. However, the maximum possible extension length of this prior-art telescoping water outlet is always less than half the overall length of its telescoped outflow conduit system.

The outflow conduit system of this prior-art water outlet is free from the action of different hydraulic forces which would be able to displace the outflow pipe. However, an undesirable longitudinal movement of the outflow pipe can occur if the axis of the water outflow direction and the direction of movement of the fitting are parallel and if the outflow pipe consequently retracts at the water outlet. Moreover, the water outlet disclosed in EP 1 707 692 A1 has a complex internal structure producible only with considerable expenditure and relies on a basic fitting body, which has been adapted in terms of design and the flow conditions of which must suit the outflow conduit system. Since this prior-art water outlet thus cannot be mounted subsequently on an already existing fitting, the possible applications for the water outlet disclosed in EP 1 707 692 A1 are further limited.

SUMMARY OF THE INVENTION

One object of the present invention therefore is to provide a water outlet of the type described above, which can be produced with relatively less expenditure and which avoids the disadvantages of the previously known prior art, without omitting the advantages thereof.

This and other objects and advantages are achieved by the water outlet according to the invention, in which the front-end region of the inner pipe disposed in the outer pipe supports an inner-pipe head comprising an annular flange that is displaceable on the inner circumference of the outer pipe, and the annular flange of the inner-pipe head comprises at least one through-flow opening. The circumference of the inner-pipe head comprises at least one through-flow opening into the annular casing space.

The end portion of the inner pipe of the water outlet according to the invention, which is disposed in the outer pipe, comprises an inner-pipe head supporting an annular flange that is displaceable on the inner circumference of the outer pipe. The outer pipe is thus guided for displacement on the annular flange provided on the inner-pipe head. While at least one through-flow opening out into the interior of the outer pipe is provided on the annular flange of the inner-pipe head, the circumference of the inner-pipe head comprises at least one through-flow opening into the annular casing space. The inner-pipe head, which is comparatively easily producible, is able to close the front-end region of the inner pipe that is disposed in the outer pipe, and simultaneously create both the at least one through-flow opening out into the annular casing space, and the through-flow opening provided between the annular casing space and the interior of the outer pipe. Moreover, production costs can be reduced further if the inner-pipe head is produced as a separate component that can be connected to the inner pipe.

If the inner-pipe head is designed as a separate component that can be connected to the inner pipe, the inner pipe, and optionally also the outer pipe, can be produced from simple pipe sections. The inner-pipe head can be locked into place particularly easily at its front-end, on the inner pipe, if the inner-pipe head has a connecting pin, which can be connected to the inner pipe, is provided with a sleeve-shaped design and can be slid on the inner-pipe front-end region or which can be inserted into the interior of the inner-pipe front-end region.

In a preferred embodiment, which limits several through-flow openings, the connecting pin is of a crown-shaped design, with several through-flow openings that are distributed over the circumference of the connecting pin and are open toward the free front end of the pin.

In particular, if the outlet end of the outer pipe of the water outlet according to the invention has a front surface of limited interior cross-section (for example, due to a stream regulator or a showerhead or the like), there could arise different water-pressure conditions in the annular casing space first on this side of the annular flange provided on the inner-pipe head, and second in the interior of the outer pipe on the other side of this annular flange. Such different water-pressure conditions can lead to an undesirable relative displacement between the inner pipe and the outer pipe. A hydraulic pressure imbalance is further intensified if, for example, the stream regulator provided as standard equipment is accidentally exchanged for a stream regulator of another flow rate class or if the perforated surfaces of the stream regulator that are provided as a wire-mesh screen or as a stream divider are encrusted with scale or are otherwise soiled.

Therefore, in accordance with a further feature of the invention, telescoping of the water outlet can be delayed or prevented by means of a braking or blocking device, which can be activated by a pressure change in the annular casing space and/or by a change in the relative position of the inner and outer pipes.

According to this feature of the invention, the water outlet of the invention comprises a braking or blocking device, which delays or even prevents the telescoping of the water outlet and, thus a relative movement between the inner and outer pipes (that is, an extension or retraction of the outlet conduit system). This braking or blocking device can thus be activated by a pressure change in the annular casing space and/or by a change in the relative position of the inner and outer pipes. If the inner and outer pipes are formed as circular pipe sections, the braking or blocking device delays or prevents any relative movement between the inner and outer pipes and thus also a rotational movement.

According to a preferred embodiment of the invention, the braking or blocking device comprises at least one braking element, which is held on the inner or outer pipe and which can be moved or deformed in the radial or transverse direction by a pressure change in the annular casing space and/or by a change in the relative position of the inner and outer pipes, in such a way that the at least one braking element acts on the inner pipe or a standpipe that is rigidly connected to a fitting housing.

In order to achieve sufficient braking effect with the at least one braking element, and the be able to activate the braking element, it is expedient i) if a frontal or circumferential inclined surface of the at least one braking element acts on a run-up slope, and if the braking element and the run-up slope assigned thereto experience a relative movement in response to a pressure change in the annular casing space and/or a change in the relative position of the inner and outer pipes in such a way that the braking element is moved or deformed in the radial or transverse direction.

According to a preferred embodiment of the invention, an annular brake piston, which is guided for displacement between the inner and outer pipes, has at least one run-up slope on its outer or inner circumference. As soon as this brake piston experiences a relative movement in the longitudinal direction of the outlet conduit system due to a pressure rise in the annular casing space and/or a retraction of the inner pipe into the outer pipe, this longitudinal movement is transformed by means of the run-up slope into a movement of the braking element in the radial or transverse direction.

If a user displaces the outer pipe in the axial or radial direction (for example, by manually adjusting the height or the circumferential position of the outlet part of the telescoping pipe), the brake does not act in such a pressure-less state, thus permitting easy adjustment by the user.

During operation of the brake, it is possible to apply a relative movement between the outer and inner pipes, albeit with increased effort, since it requires overriding the braking effect resulting from the suppressed longitudinal movement between the outer and inner pipes, due to different pressure conditions and different active surfaces. However, the force required for displacement of the outer pipe is limited since in a positively controlled displacement of the outer pipe, the at least one braking element is likewise pressed outwardly by an inclined surface, but the radial force action is ultimately limited by the friction and sliding conditions on the inner seal of the brake piston facing the inner pipe. As a result, no additional radial forces are transferred onto the standpipe once there occurs sliding friction between the brake piston and the inner pipe.

The components of the braking or blocking device are easily assembled if the outer pipe has at least one through-opening which is penetrated by a braking element, if the frontal or circumferential side of the braking element that is oriented toward the inner pipe comprises the inclined surface that acts on a run-up slope disposed on the brake piston and if that opposite frontal or circumferential side of the braking element that is oriented toward the exterior cooperates with a standpipe encompassing the outer pipe. The at least one braking element is thus held in the through-opening of the outer pipe. The frontal or circumferential side of the braking element that is oriented toward the inner pipe and is formed as an inclined surface, engages in the run-up slope disposed on the brake piston. It is thus connected to the outer and inner pipes such that it can be displaced along the inclined surface and the run-up slope. Due to a pressure rise in the annular casing space and/or a change in the relative position of the inner and outer pipes, the brake piston is moved slightly in the longitudinal direction of the outlet conduit system. This longitudinal movement of the brake piston is transferred from the run-up slope of the same onto the inclined surface of the at least one braking element. The latter thus experiences a movement in the radial or transverse direction toward the standpipe. In doing so, the at least one braking element rests against the standpipe in such a way that the telescoping ability of the water outlet can be delayed or prevented by means of the braking or blocking device.

As long as the brake piston simultaneously also forms the fitting-side closure of the annular casing space, it is advantageous if the brake piston is sealed with respect to the inner pipe or the outer pipe by means of at least one slide ring seal.

According to a particularly simple embodiment that is reduced to only a few components, the braking element is provided with a circular shape, and can be expanded in the radial direction by a pressure change in the annular casing space and/or by a change in the relative position of the inner and outer pipes.

In order to release the braking effect as completely as possible, and to carry out a return movement of the braking element, it is advantageous if the braking element is produced from an elastic material.

A secure hold of the telescoping water outlet is promoted if the outer pipe is guided for displacement in the standpipe.

According to preferred exemplary embodiments, a showerhead and/or a stream regulator is provided at the outlet end of the water outlet. A showerhead can be adapted individually to the height of the user with the help of the telescoping water outlet. The telescoping water outlet can also be used, to advantage, at a kitchen sink, and can render unnecessary a flexible water hose as the fitting outlet. If the kitchen spray-head is formed as a so-called duo-spray head, which can be adjusted between a spray function and a water jet function, it may be advantageous if the water outlet can optionally be switched between the spray function and the jet function controlled by a stream regulator.

Thus, in the two stream types, namely jet/spray, there usually occur different hydraulic resistances and thus different flow rates. This induces a varying pressure drop in the telescopic unit, which in a system without a braking device, would cause the previously inactive system to become unbalanced due to a shift in the balance of forces, thus causing an undesirable extension or retraction of the telescoping outlet. This is prevented by the braking device provided in accordance with the present invention.

Additional features of the invention are discernible from the following description of an exemplary embodiment of the invention in connection with the claims and also the drawings. The features can be implemented individually or combined in an embodiment in accordance with the invention.

DETAILED DESCRIPTION OF THE INVENTION

Figure 1:
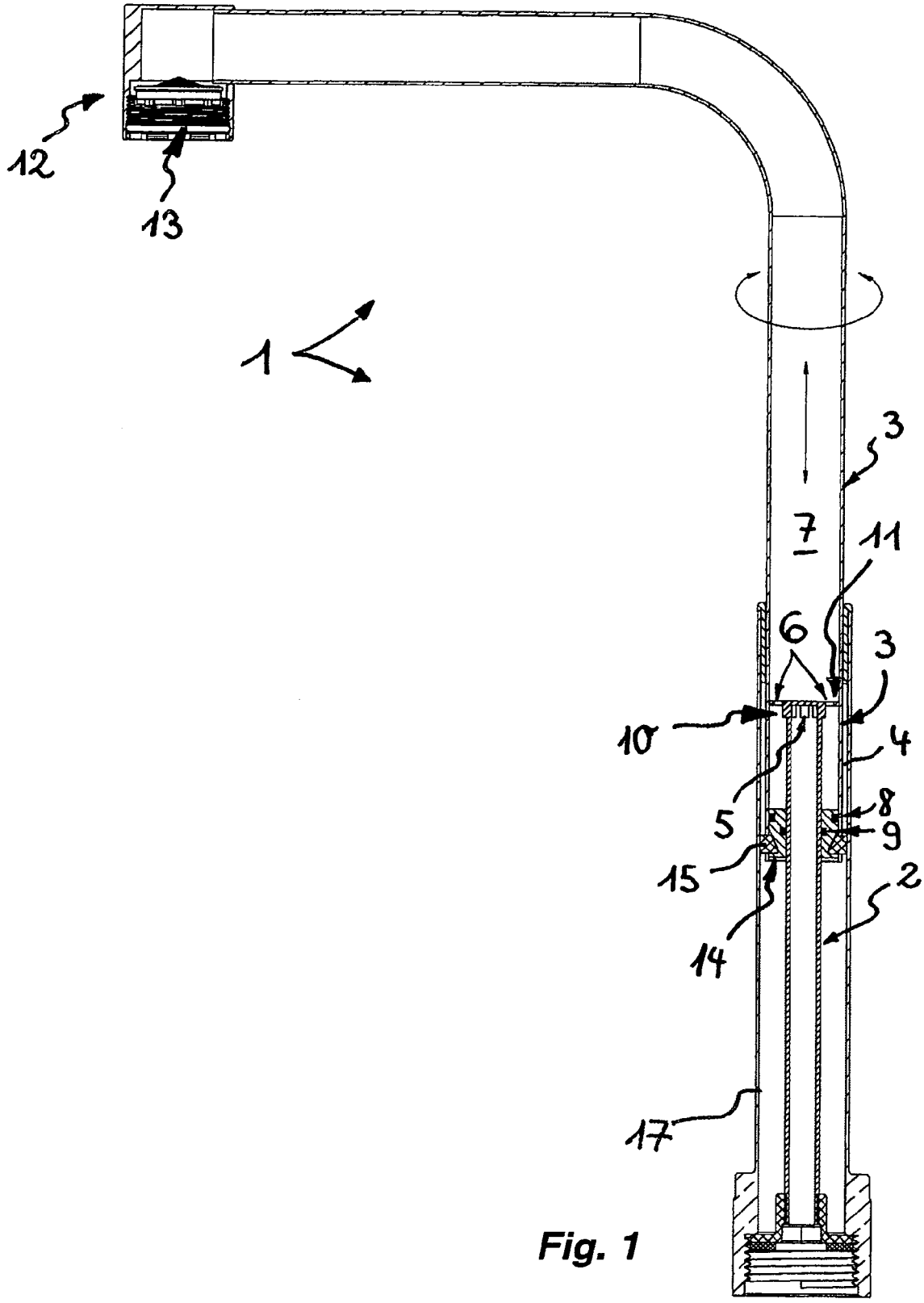
FIG. 1 shows a longitudinal section of a telescoping water outlet, which has an inner pipe through-flow pipe and an outer pipe discharge pipe, with a braking device being effective between the inner and outer pipes.

FIGS. 1 to 8 show the essential components of a telescoping water outlet 1, which has an inner flow-through pipe 2 and an outer discharge pipe 3, with outer pipe 3 encompassing the inner pipe 2 at a distance, so as to form a water-bearing annular casing space 4. The end portion of the inner pipe 2 that is disposed within the outer pipe 3 (uppermost in FIG. 1) is closed, and its circumferential surface 2 has several through-flow openings 5, out into the annular casing space 4. The end of the annular casing space 4 that is disposed on the outlet side (that is, nearest the outlet end 12) is connected to the interior 7 of the outer pipe 3 via several through-flow openings 6, while the end of the annular casing space 4 that is oriented away from the outlet side is sealed by slide ring seals 8, 9 that bear in a displaceable manner against the outer pipe 3 and inner pipe 2 respectively.

That end portion of the inner pipe 2 that is disposed in the outer pipe 3 has an inner-pipe head 10 with an annular flange 11 that bears displaceably against the inner circumference of the outer pipe 3. The annular flange 11 of this inner-pipe head includes the through-flow openings 6 while the through-flow openings 5 (which open out into the annular casing space 4) are provided on the circumference of the inner-pipe head 10. The outer pipe 3 is thus guided for displacement on the annular flange 11 provided on the inner-pipe head 10.

The comparatively easily producible inner-pipe head 10 is able to close off the end portion of the inner pipe 2 that is within disposed in the outer pipe 3, and simultaneously to create both the at least one through-flow opening 5 opening out into the annular casing space 4 and the through-flow openings 6 provided between the annular casing space 4 and the interior 7 of the outer pipe. Since the inner-pipe head 10 can (optionally) be produced as a separate component that can be connected to the inner pipe 2, both the inner pipe 2 and the outer pipe 3 can be produced from simple pipe sections, preferably of circular cross-section, for example.

Since the outlet end 12 of the outer pipe 3 of the water outlet 1 has a front surface of limited interior cross-section due to a stream regulator 13 or a showerhead or the like, it is possible that different water-pressure conditions could arise in the annular casing space 4 (that is, on the casing space side of the annular flange 11), and in the interior 7 of the outer pipe 3 on the other side of the annular flange 11. Such different water-pressure conditions can lead to an undesirable relative displacement between the inner pipe 2 and the outer pipe 3. A hydraulic pressure imbalance is further intensified if, for example, the stream regulator 13 that is provided as standard equipment is accidentally exchanged for a stream regulator of a different flow rate class or if the perforated surfaces of the stream regulator 13 that are provided as a wire-mesh screen or as a stream divider are encrusted with scale or are otherwise soiled.

In order to address this undesirable possibility, the telescoping water outlet 1 according to the invention (illustrated here) comprises a braking or blocking device 14, which delays or prevents telescoping of the water outlet 1, and which particularly counteracts an accidental retraction or extension of the water outlet 1. The braking or blocking device 14 can be activated for this purpose by a pressure rise in the annular casing space 4 and/or by retracting the inner pipe 2 into the outer pipe 3.

As best seen in FIGS. 1-4, the braking or blocking device 14 comprises at least one braking element 15, which is held on the outer pipe 3. The braking element 15 can be moved in the radial direction by a pressure change in the annular casing space 4, and/or by a retraction of the inner pipe 2 into the outer pipe 3, in such a way that the at least one braking element 15 acts with a frictional fit on the inner circumference of a standpipe 17 that is rigidly connected to a basic fitting body and encloses sections of the outer pipe 3. As a result, both longitudinal and rotational movements between the inner and outer pipes 2, 3 are delayed or prevented.

Figure 2:
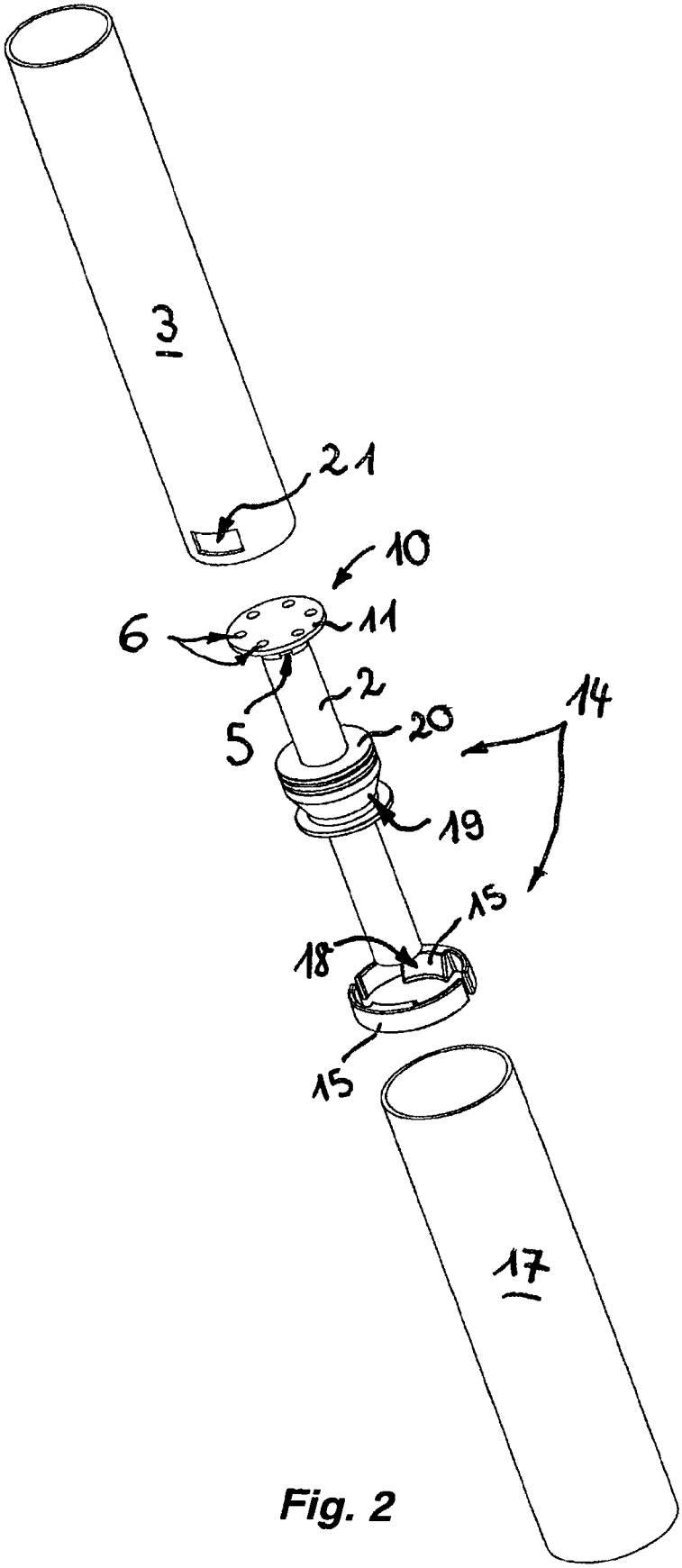
FIG. 2 is an exploded view of a portion of the water outlet shown in FIG. 1.
Figure 3:
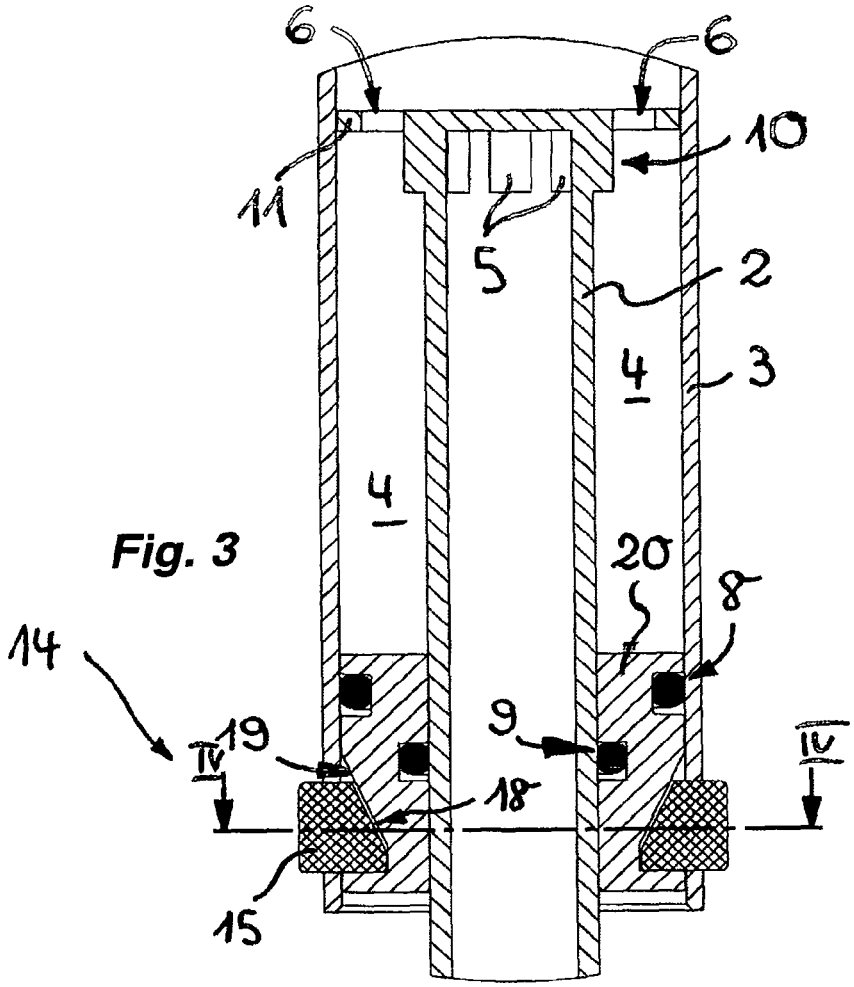
FIG. 3 shows a longitudinal section of the region of the braking device of the inner and the outer pipes of the water outlet shown in FIGS. 1 and 2.
Figure 4:
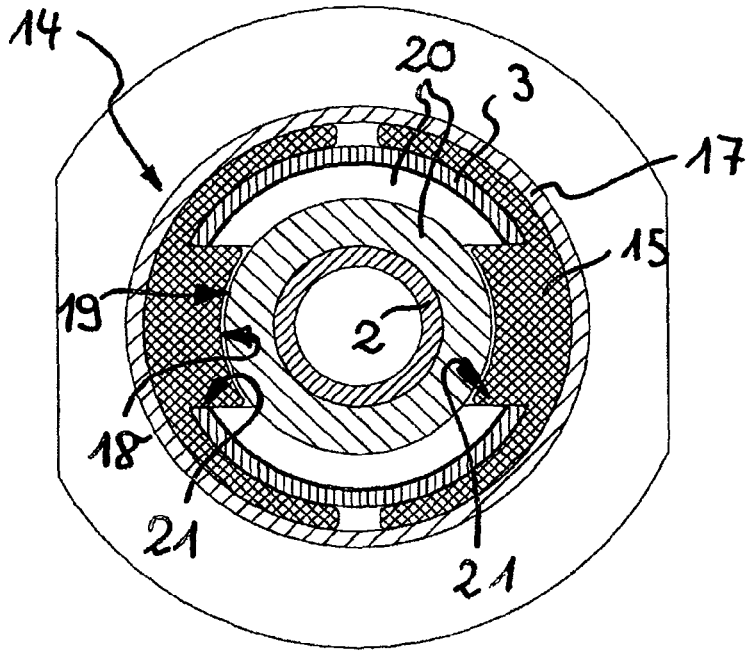
FIG. 4 shows a cross-section, taken along the sectional plane IV-IV indicated in FIG. 3, of the inner and the outer pipes of the water outlet illustrated in FIGS. 1 to 3.
Figure 5:
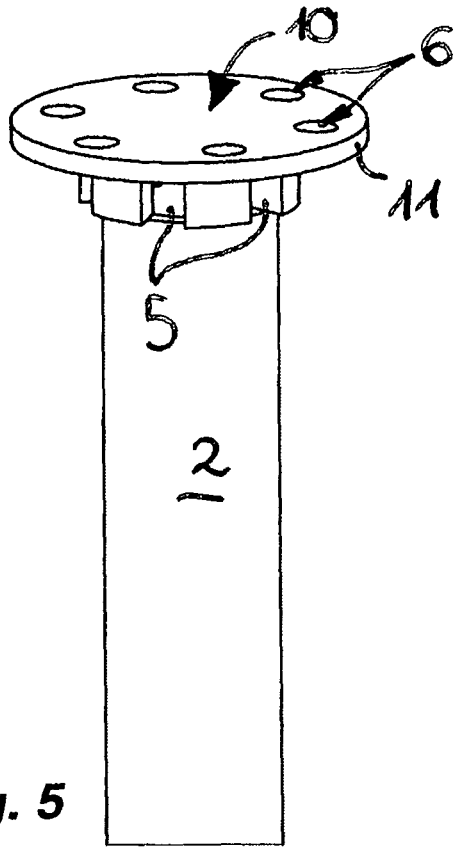
FIG. 5 shows a perspective partial view of the inner pipe of the water outlet shown in FIGS. 1 to 4.
Figure 6:
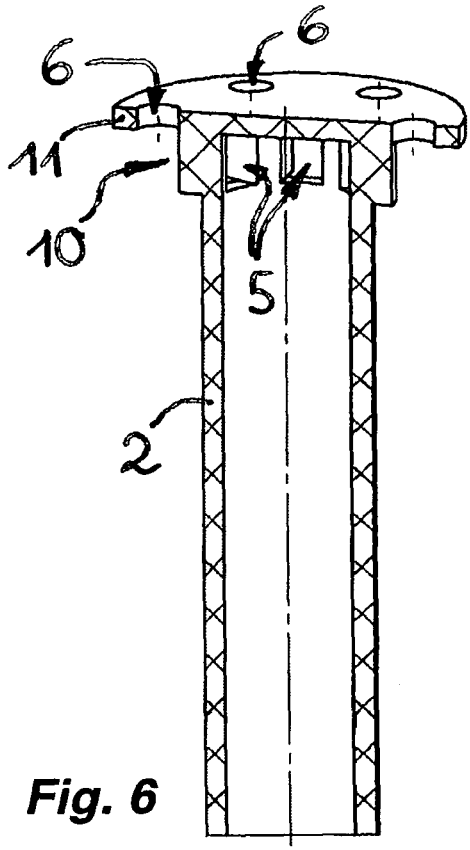
FIG. 6 shows a longitudinal section of the inner pipe from FIG. 5.
Figure 7:
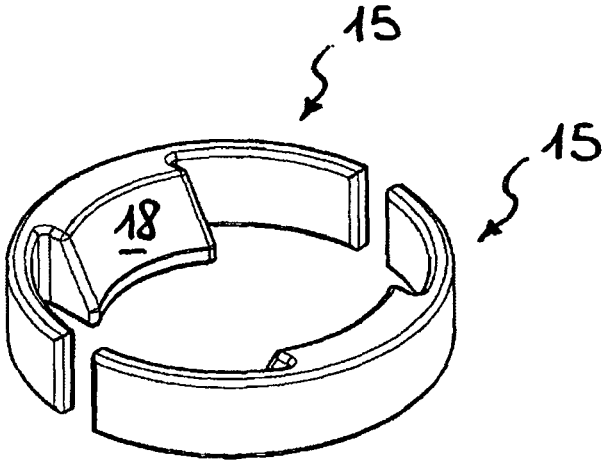
FIG. 7 shows the two circle-segment shaped braking elements of the braking device designed for the water outlet shown in FIGS. 1 to 6.
Figure 8:
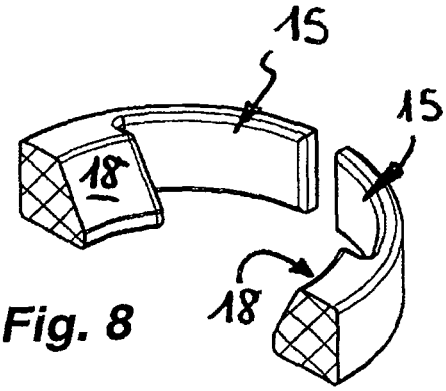
FIG. 8 shows the braking elements of FIG. 7, which are cut approximately in half along a common sectional plane in the longitudinal direction.

As best seen in FIGS. 2, 3, 7 and 8 the at least one braking element 15 has a frontal or circumferential inclined surface 18 that acts on a run-up slope 19 (FIGS. 2 and 3). This run-up slope 19 is disposed on an annular brake piston 20 (FIGS. 2, 3), which is guided for displacement in the annular casing space 4 between the inner and outer pipes 2, 3. Due to either a pressure rise in the annular casing space 4 and/or a retraction of the inner pipe 2 into the outer pipe 3, the brake piston 20 experiences a longitudinal movement which is transferred from the run-up slope 19 disposed on the outer circumference of the brake piston 20 onto the inclined surface 18 disposed on the braking element 15 and is converted into a radial movement of the at least one braking element 15. By virtue of this radial movement, the braking element 15 acts with a frictional fit on the inner circumference of the standpipe 17, such that relative movement between the inner and outer pipes 2, 3 is either delayed or prevented for the time being.

In order to interconnect the components of the braking or blocking device 14, the outer pipe 3 has at least one through-opening 21 (FIG. 4) which is penetrated by the at least one braking element 15. While that frontal or circumferential side of the braking element 15 oriented toward the inner pipe 2 comprises the inclined surface 18, the opposite frontal or circumferential side that is oriented toward the exterior, cooperates with the standpipe 17 encompassing the outer pipe 3.

The brake piston 20 here forms the fitting-side closure of the annular casing space 4. In order to seal the annular casing space 4 in the region of the brake piston as well, slide ring seals 8, 9 are provided, which are each disposed in an annular groove on the respective outer and inner circumference of the annularly formed brake piston 20 encompassing the inner pipe 2.

The braking element 15 can be provided with a circular shape and can be expanded in the radial or transverse direction by a pressure change in the annular casing space and/or by a change in the relative position of the inner and outer pipes 2, 3. However, it is also possible as in the case illustrated, to provide several braking elements 15 spaced apart, preferably at equal intervals, on the brake piston 20. In particular, a circular braking element can be produced from an elastic material in order to achieve a release of the braking or blocking device 14 and a return movement of the braking element 15 after every braking or blocking process.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A telescoping water outlet comprising:

an inner through-flow pipe;

an outer discharge pipe which encircles the inner pipe at a distance, forming an annular casing space between said inner and outer pipes; wherein, an end portion of the inner pipe that is disposed within the outer pipe supports an inner-pipe head having an annular flange that bears displaceably on the inner circumference of the outer pipe;

the annular flange of the inner-pipe head comprises at least one through-flow opening; and a circumference of the inner-pipe head comprises at least one through-flow opening which opens into the annular casing space;

the outer pipe has at least one through-opening, which is penetrated by a braking element;

an inner circumferential side of the braking element, which is oriented toward the inner pipe, comprises surface that acts on corresponding surface of a brake piston; and an opposite circumferential side of the braking element, which is oriented toward an exterior, cooperates with an inner surface of a standpipe that encloses the outer pipe.

2. The water outlet according to claim 1, wherein the inner-pipe head comprises a separate component that can is connectable to the inner pipe.

3. The water outlet according to claim 1, wherein the inner-pipe head has a connecting pin, which:

is connectable to the inner pipe;

is in the form of a sleeve; and is slidable on the inner-pipe front-end region or can be inserted into the interior of the inner-pipe front-end region.

4. The water outlet according to claim 3 wherein the connecting pin is crown-shaped, with a plurality of through-flow openings, that are distributed over its circumference, and are open toward a free front end of the pin.

5. The water outlet according to claim 1, wherein:

telescoping ability of the water outlet can be delayed or prevented by means of the braking element;

the braking element can be activated by either a pressure change in the annular casing space or by a change in the relative position of the inner and outer pipes.

6. The water outlet according to claim 5, wherein the braking element can be moved or deformed in the radial or transverse direction by a pressure change in the annular casing space and/or by a change in the relative position of the inner and outer pipes, in such a way that the braking element bears against the standpipe that is rigidly connected to a basic fitting body.

7. The water outlet according to claim 6, wherein:

the surface of the inner circumferential side of the braking element is an inclined surface and the corresponding surface of the brake piston is a run-up slope; and the braking element and the run-up slope experience a relative movement due to a pressure change in the annular casing space or a change in the relative position of the inner and outer pipes, such that the braking element is moved or deformed in a radial direction.

8. The water outlet according to claim 6, wherein the braking element has a circular shape and can be expanded radially to bear against the standpipe by a pressure change in the annular casing space or by a change in relative position of the inner and outer pipes.

9. The water outlet according to claim 6, wherein the braking element is produced from an elastic material.

10. The water outlet according to claim 1, wherein:

the surface of the inner circumferential side of the braking element is an inclined surface and the corresponding surface of the brake piston is a run-up slope.

11. The water outlet according to claim 10 wherein the outer pipe is guided for displacement within the standpipe.

12. The water outlet according to claim 1, wherein the brake piston is sealed in relation to at least one of the inner pipe and outer pipes, by at least one slide ring seal.

13. The water outlet according to claim 1, wherein an outlet end of the water outlet has one of a showerhead and a stream regulator.

14. A telescoping fluid outlet structure for a fluid pipe, said telescoping outlet comprising:

an outlet pipe having a fluid outlet opening at an end thereof;

an inner pipe, at least a longitudinal portion of which is disposed within and surrounded by the outlet pipe, with an outer diameter of the inner pipe being smaller than an inner diameter of the outlet pipe, so that an annular space exists between said inner pipe and said outlet pipes;

an inner pipe head that is mounted to and closes an end of the inner pipe nearest said outlet opening, and includes an annular flange that bears displaceably against an inner wall of said outlet pipe;

at least one fluid flow opening disposed on a circumferential surface of said inner pipe head and connecting an interior of said inner pipe with said annular space;

at least one fluid flow opening in said annular flange, connecting said annular space with an interior of said outlet pipe;

a standpipe that surrounds at least a longitudinal portion of the outlet pipe;

a braking element that penetrates at least one through-opening of the outlet pipe; and a brake piston arranged between the inner pipe and the outlet pipe, wherein an inner circumferential side of the braking element, which is oriented toward the inner pipe, comprises surface that acts on corresponding surface of the brake piston, and an opposite circumferential side of the braking element, which is oriented toward an exterior, cooperates with an inner surface the standpipe.

15. The water outlet according to claim 14, wherein the standpipe is rigidly connected to a basic fitting body, and wherein the braking element can be moved or deformed in a radial direction by a pressure change in the annular space or by a change in the relative position of the inner pipe and the outlet pipe, such that the element bears against said standpipe.

16. The water outlet according to claim 15, wherein:

the surface of the inner circumferential side of the braking element is an inclined surface and the corresponding surface of the brake piston is a run-up slope, such that either a change of pressure in said annular space or a relative movement of said inner pipe and said outlet pipe forces inclined surface and the run-up slope engage one another, causing radial deformation or movement of said braking element.

* * * * *